US006902493B1

(12) United States Patent
Rhodes et al.

(10) Patent No.: US 6,902,493 B1
(45) Date of Patent: Jun. 7, 2005

(54) ADJUSTABLE LASER FOR IMPROVING A GOLFER'S PUTTING STROKE

(76) Inventors: Charles R. Rhodes, 130 Lorenzo Dr., Pleasant Hill, CA (US) 94523; Paul H. Warner, 1406 Santa Clara, Alameda, CA (US) 94501; Vincent J. Tringali, 2808 Buckingham Dr., Kelseyville, CA (US) 95451; Arthur J. Zanello, 15 Hidden Ter., Hillsborough, CA (US) 94010

( * ) Notice: Subject to any disclaimer, the term of this patent is extended or adjusted under 35 U.S.C. 154(b) by 0 days.

(21) Appl. No.: 10/884,241

(22) Filed: Jul. 2, 2004

(51) Int. Cl.[7] ..... A63B 69/36
(52) U.S. Cl. ..... 473/268; 473/209; 362/191
(58) Field of Search ..... 473/207–211, 220–223, 473/267–269, 274, 275; 362/191

(56) References Cited

U.S. PATENT DOCUMENTS

| | | | | |
|---|---|---|---|---|
| 1,169,188 | A | 1/1916 | Peck | |
| 3,032,647 | A | 5/1962 | Wansky et al. | |
| 3,953,034 | A | 4/1976 | Nelson | 273/186 C |
| 4,303,244 | A | 12/1981 | Uppvall | 273/183 |
| 4,406,040 | A | 9/1983 | Cannone | 24/3 J |
| D277,995 | S | 3/1985 | Hand, Jr. | D2/241 |
| 4,560,166 | A | 12/1985 | Emerson | 273/183 B |
| 4,869,509 | A | 9/1989 | Lee | 273/183 B |
| 4,991,068 | A | 2/1991 | Mickey | 362/106 |
| 5,199,712 | A | 4/1993 | Hoyle, Jr. et al. | 273/187.2 |
| 5,284,345 | A | 2/1994 | Jehn | 273/187.2 |
| 5,335,150 | A | 8/1994 | Huang | 362/118 |
| 5,467,992 | A | 11/1995 | Harkness | 273/187.2 |
| 5,663,828 | A | 9/1997 | Knowles et al. | 359/237 |
| 5,718,496 | A | 2/1998 | Feldman et al. | 353/42 |
| 5,733,202 | A | 3/1998 | Vargo | 473/220 |
| 5,738,595 | A | 4/1998 | Carney | 473/209 |
| D403,450 | S | 12/1998 | Ting | D26/37 |
| 5,879,239 | A | 3/1999 | Macroglou | 473/209 |
| 5,882,106 | A * | 3/1999 | Galli | 362/259 |
| 6,007,436 | A | 12/1999 | Mark | 473/409 |
| 6,467,929 | B2 * | 10/2002 | Lee | 362/191 |
| 6,672,972 | B1 * | 1/2004 | Stone | 473/207 |

* cited by examiner

*Primary Examiner*—Stephen Blau
*Assistant Examiner*—Nini F. Legesse
(74) *Attorney, Agent, or Firm*—James G O'Neill, Klein & Singh, LLP

(57) ABSTRACT

A laser device for teaching and improving the putting stroke of a golfer. The device includes a housing having a power source, an on/off switch a laser, a reflective surface rotatable by a handle and a lever system, a P.C. board and a switch to prevent the laser from being accidentally shone in the eyes of other persons. The device places a light dot on a golf ball or target area and indicates any undesirable body or head motion that will be noted by movement of the light dot by a golfer while standing over and stroking a putter with an aligned sweet spot. The device also allows a golfer to use a light dot to draw an imaginary line between a golf ball being struck and a cup to improve a golfer's visualization of the travel line of the ball after stroking it with the aligned putter sweet spot.

20 Claims, 3 Drawing Sheets

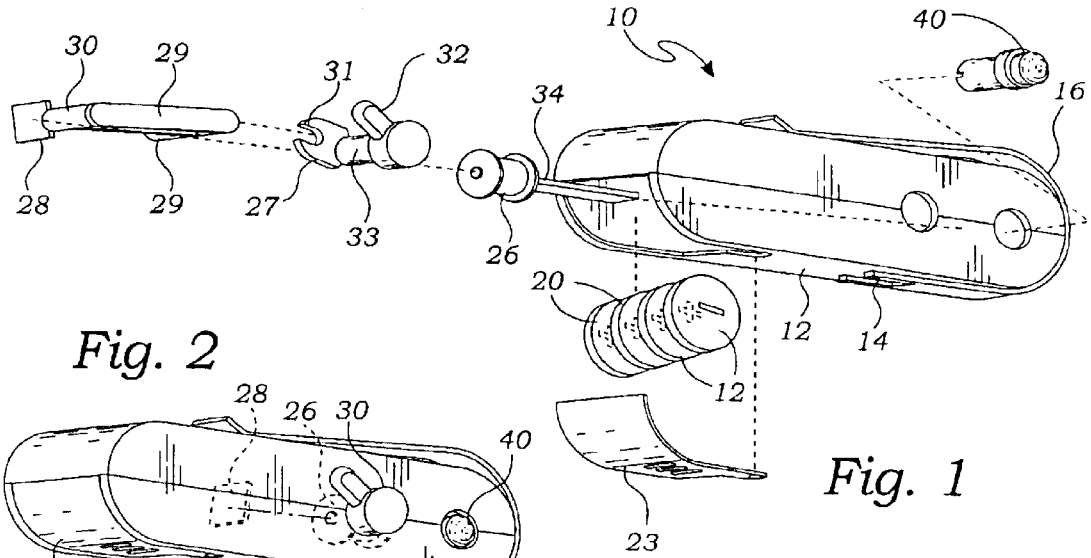
Fig. 2
Fig. 1
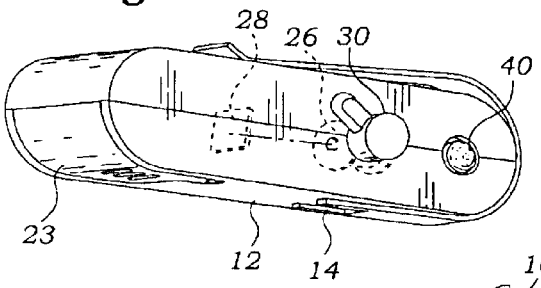
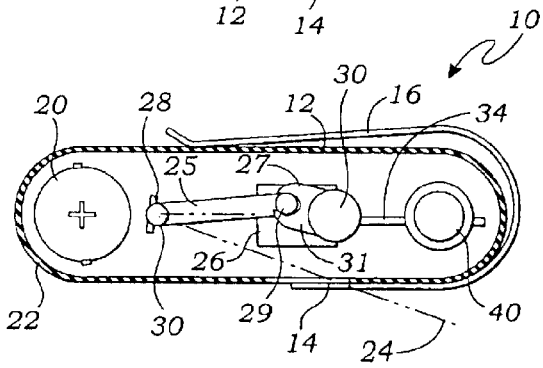
Fig. 3
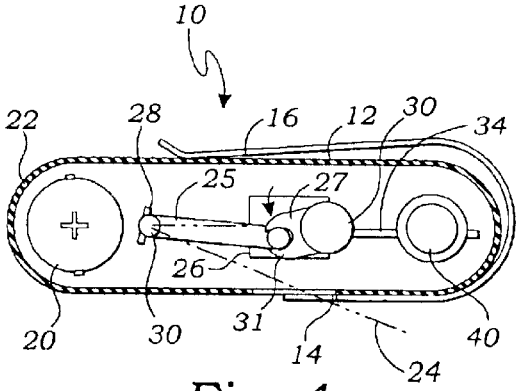
Fig. 4
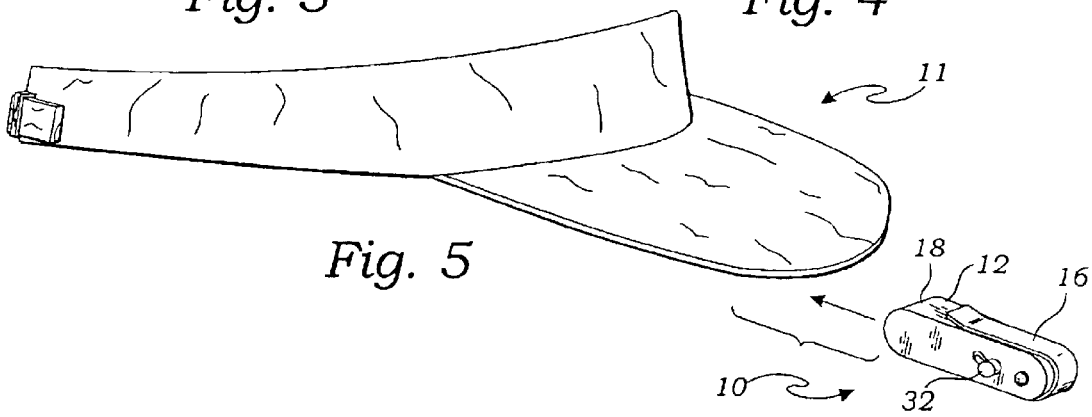
Fig. 5

ADJUSTABLE LASER FOR IMPROVING A GOLFER'S PUTTING STROKE

BACKGROUND OF THE INVENTION

1. Field of the Invention

This invention relates generally to teaching aids, and more particularly, to an easily and accurately adjustable light source, such as a laser, for improving the putting stroke of a golfer.

2. Description of Related Art

As is well known to golfers, the holding of a golf club, body alignment to the ball and stroke, together with clubface alignment when hitting a golf ball are important in playing a good consistent game of golf. In this connection, numerous devices and methods have been adopted, and many patents obtained on devices and methods for improving golf strokes. Examples of such known devices and methods are set forth in the following U.S. patents:

Des.277,955 to Head, Jr.; U.S. Pat. No. 1,169,188 to Peck;

U.S. Pat. No. 3,953,034 to Neson U.S. Pat. No. 4,303,244 to Uppvall;

U.S. Pat. No. 4,560,166 to Emerson; U.S. Pat. No. 4,869,509 to Lee;

U.S. Pat. No. 5,199,712 to Hoyle, Jr. et al.; U.S. Pat. No. 5,284,345 to Jehn;

U.S. Pat. No. 5,467,992 to Harkness; U.S. Pat. No. 5,733,202 to Vargo;

U.S. Pat. No. 5,879,239 to Macroglou; and U.S. Pat. No. 6,007,436 to Mark.

Additionally, numerous patents have been obtained on lamps or lights for attachment to hats. Examples of such known lamps or lights are set forth in the following U.S. patents: 3,032,647 to Wansky et al.; 4,406,040 to Cannone; and 4,991,068.

Furthermore, numerous patents have been obtained on laser pointing devices. Examples of such known laser pointing devices are set forth in the following U.S. patents:

Des. 403,450 to Ting; U.S. Pat. No. 5,335,150 to Huang;

U.S. Pat. No. 5,663,828 to Knowles et al.; U.S. Pat. No. 5,718,496 to Feldman et al.; and U.S. Pat. No. 5,738,595 to Carney.

The known devices aid a person using them to accomplish specific task and to provide assistance to a golfer trying to improve his or her swing, while permitting the golfer to identify when his or her head is moving, by use of various motion-detecting alarms or lights. However, the known devices and methods do not adequately work for all golfers, nor do they provide the necessary repetitions to create "muscle memory" needed to produce a consistent putter stroke.

Therefore, there exists a long felt need in the art for an improved and simplified device which permits a golfer to improve their golf stroke, by preventing improper body and head movement, particularly during a putting stroke, while teaching the correct use of a putter to provide consistency in putting.

SUMMARY OF THE INVENTION

Accordingly, it is a general object of the present invention to provide an improved and simplified device for aiding a golfer in putting. It is a particular object of the present invention to provide an improved and simplified laser illumination device for use in teaching good putting stroke technique. It is another particular object of the present invention to provide an improved laser illumination device for clipping to the underside of a bill or brim of a golfer's cap or visor. It is yet another particular object of the present invention to provide an improved and simplified laser illumination device for use in teaching golf putting technique and preventing body and head movement. It is yet a further particular object of the present invention to provide an improved laser illumination device having a more precise illuminating dot to help a golfer identify body and head movement and a preferred travel line of a golf ball, before performing a putting stroke. And, it is a still further particular object of the present invention to provide an improved device to aid a golfer in improving the consistency of putting strokes, having an illuminated dot that is precisely moved by a lever system and which is aimed at a particular target spot (e.g., a golf ball) and a hole along a preferred travel line, to aid in the creation of correct muscle memory so as to create consistently good putting strokes.

These and other objects of the present invention are achieved by providing a laser module housed in a molded body, which laser shines a bright red dot on a target spot or golf ball, and which clips to the underside of any bill or brim of a golfer's cap or visor. The laser module may be used while practicing or playing, either indoors or outdoors. The laser module is battery-operated and lightweight, is minimal in size, utilizes an electronic switch to prevent accidental shining of the laser in other people's eyes, and includes a push button on/off switch. Additionally, the laser module includes an internal user-adjustable reflective surface having very precise control to redirect the laser beam to a desired location after assuming a correct putting stance. Also, the present invention involves using the illuminated dot from the laser to aid a golfer in practicing strokes by first targeting a golf ball and then targeting a cup by tracing the dot along a preferred travel line of the ball to the cup.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawing, in which:

FIG. 1 is a partially exploded perspective view of a preferred embodiment of the laser module of the present invention;

FIG. 2 is a further perspective view of the assembled laser module;

FIGS. 3 and 4 are partial cross-sectional views of the laser module;

FIG. 5 is a perspective view of a visor with a preferred embodiment of the laser module of the present invention shown being clipped underneath the brim of the visor;

DETAILED DESCRIPTION OF THE PREFERRED EMBODIMENTS

The following description is provided to enable any person skilled in the art to make and use the invention, and sets forth the best modes contemplated by the inventors of carrying out their invention. Various modifications, however, will remain readily apparent to those skilled in the art, since the generic principles of the present invention have been defined herein, specifically to provide for an improved and simplified device for teaching the targeting of a golf ball during a stroke wherein the head should be kept still, such as when using a putter or the like.

Good muscle memory creates consistency in stroking a golf ball, and particularly in short strokes, such as putting or chipping. Therefore, the primary goal in good short stroke technique is to have consistency. As is well known, unwanted body or head movement during the short strokes, such as a putting stroke will destroy such consistency. The present invention helps to eliminate such unwanted body or head movement, and teaches proper stroke consistency by using the novel lighting device of the present invention to more effectively teach a golfer how to properly make short strokes, such as a putt.

Figure 6:
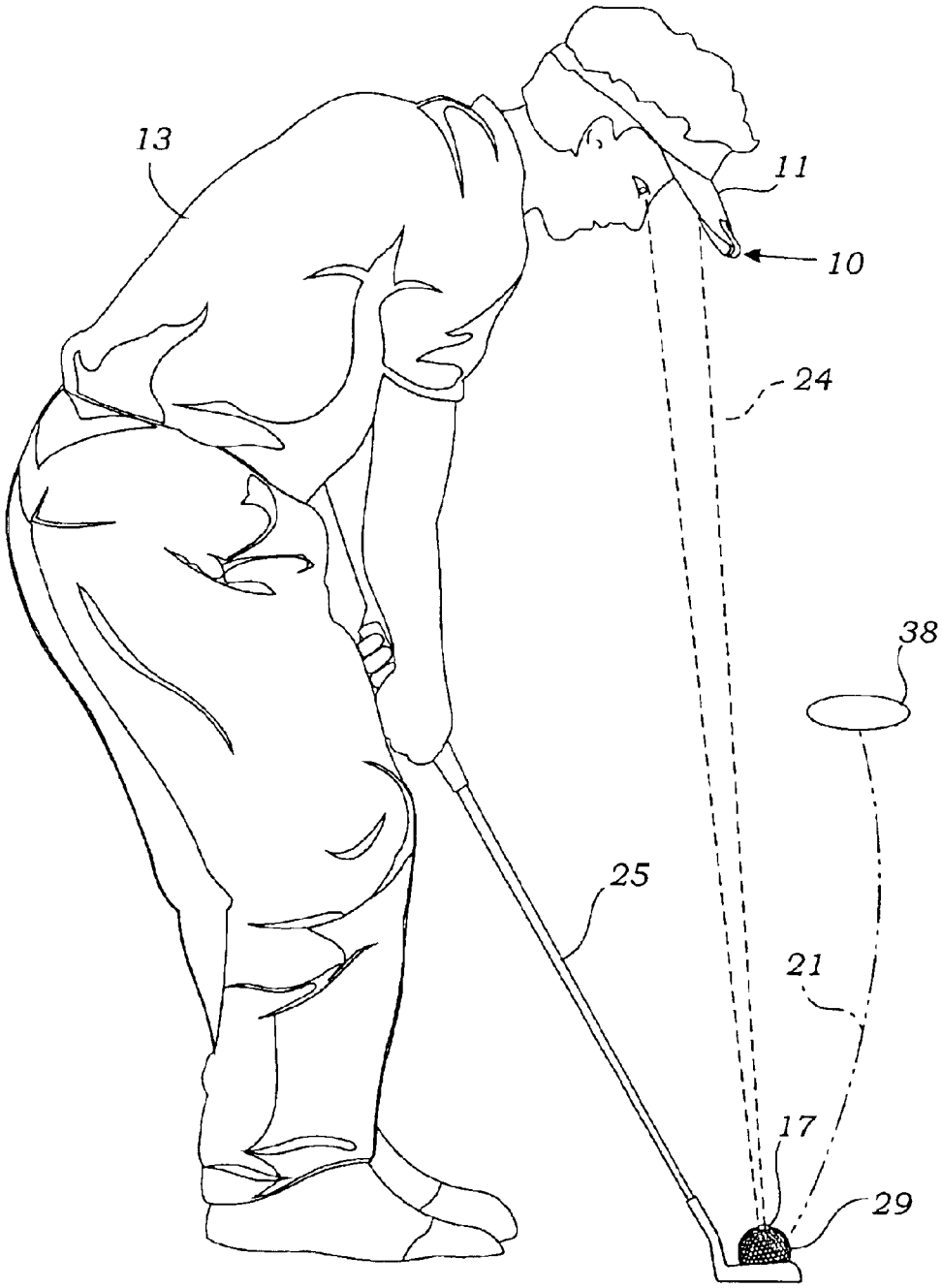
FIG. 6 is a side elevational view of a golfer wearing a visor and laser module of the present invention standing over and shining a red dot down onto a golf ball while aiming toward a cup.

In one embodiment of the present invention a device or module 10 has a light source, preferably a laser as shown in FIGS. 1–4 of the drawings and as described more fully below. A golfer 13 (see FIGS. 6–8) will place or wear the device 10 on the underside of a bill or brim of a cap, hat or visor 11. In this position, because the laser device 10 is sized and dimensioned to fit the golfer 13, an operative end 22 of the laser device is very closely placed between the golfer's eyes, and in close proximity to the forehead of the golfer. This exact placement of the operative end 22 of the device 10 between the eyes reduces parallax because of the closeness of the light source to the golfer's eyes thereby placing the path of the laser dot in the line of sight of the golfer's vision path, thus creating a realistic replication of the performance of the eyes. Therefore, no special hat or visor is required for mounting the device 10. Furthermore, the device 10 is designed so that the golfer's vision is not impaired and because of the small physical size of the device, the golfer's concentration is not disturbed. Additionally, because of the close proximity of the vision path to the laser dot path, a very clear circular, concentrated light dot, with substantially no edge feathering is produced, whereby consistently improved putting results are obtained.

As best shown in FIGS. 1–4, a currently preferred embodiment of the laser module 10 comprises a body or housing 12, having a first, inner or operative end 22 and a second, outer or holding end 18. The first or operative end 22 has a power source 20, such as one or more batteries, insertable through a door opening 23 in the first end, and an illuminating beam 24 is emitted through an opening 14, from a light source 26, such as from a laser diode, held in the housing 12. A clip 16 is secured to the exterior housing 12 at second end 18 for mounting the device 10 to the underside of a bill or the like on the cap, hat or visor 11 (see FIGS. 5–8). The illuminating beam 24 is redirected by an adjustable reflective surface 28, such as a mirror, to a desired location, between preferred angles of approximately 36° to 10°. The adjustable reflective surface 28 is held in a body 30 rotatably held in the housing 12. The body 30 and reflective surface 28 are precisely moved by an exterior handle 32 and inner levers 25, 27, rotatably secured between the body 30 and the exterior handle 32. A first of the internal levers 25 is secured to the body 30 and ends in an enlarged portion 29, held in a forked portion 31 of lever 27. The inner lever 27 is secured to a shaft 33 rotatably held in the housing 12 and carrying the handle 32. The housing 12 also includes an on/off switch 40 for activating the laser.

The unique construction of the mirror lever operating system and its placement in the housing 12 allows the laser beam 24 projected by the reflective surface 28 to start from a point which is in close proximity to the eyes and very close to a golfer's forehead. This minimizes the disturbing parallax that would normally be found between the projected beam and the normal eye visualization path.

Figure 7:
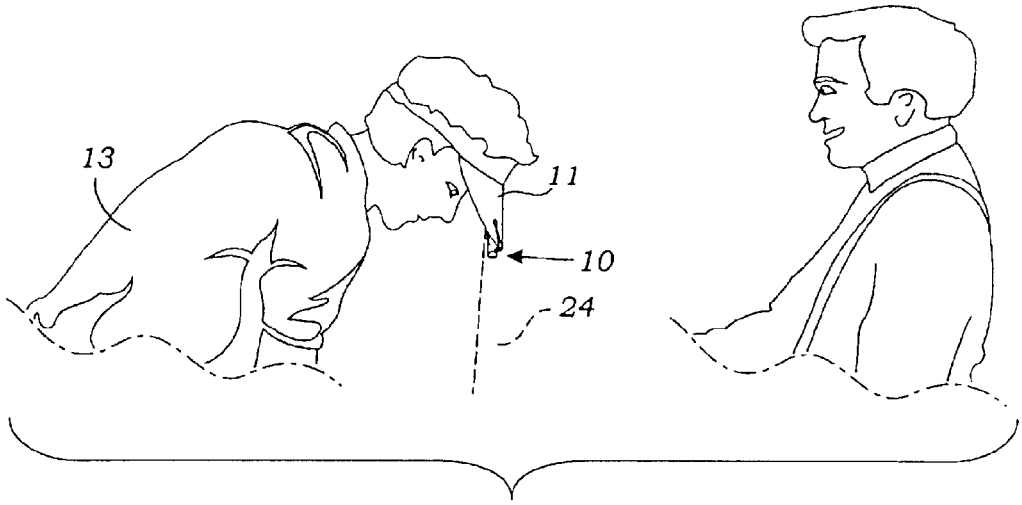
FIGS. 7 and 8 are views of a golfer wearing the laser illumination device of the present invention, which is deactivated when the golfer raises his/her head to prevent shining of the laser into the eyes of a bystander.
Figure 8:
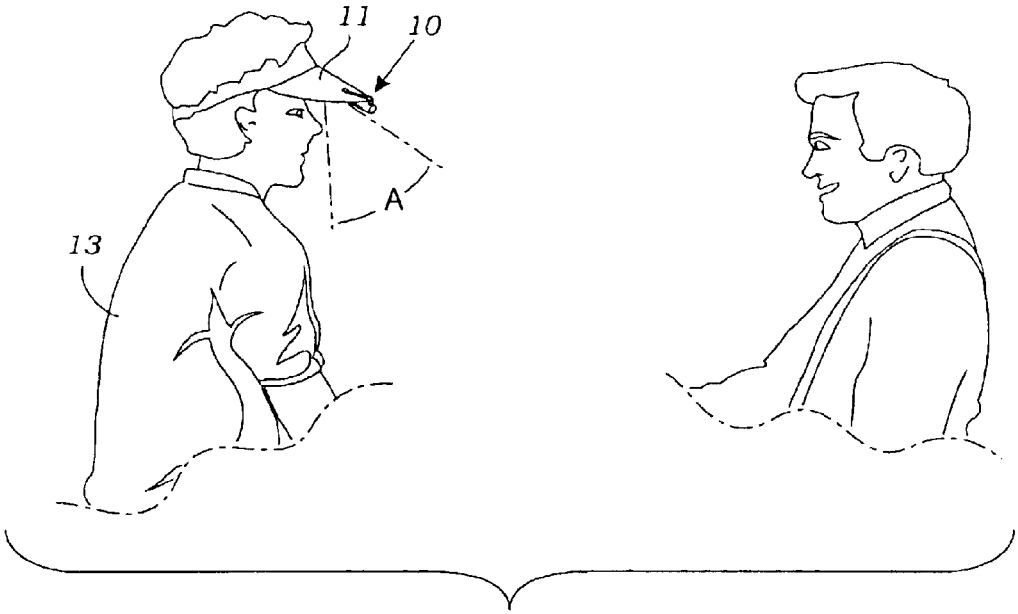

A P.C. board 34 is held in the housing 12 and connected to the laser diode 26 and remaining components in any acceptable manner, and includes an electronic or other type switch thereon to shut off the laser when a golfer wearing the same moves their head upwardly, to prevent accidental shining of the laser light into a bystander or any other person's eyes (see FIGS. 7 and 8). The P.C. board 34, batteries 20, laser 26 and on/off switch 40 are electrically connected and grounded so as to operate safely in the housing 12.

A currently preferred method of using the device or laser module 10 of the present invention, will now be described. After the laser or lighting device 10 is placed on the underside of the golfer's hat or visor 11 with the end 22 closely adjacent the golfer's forehead, between the golfer's eyes, a target area or golf ball 29 is placed on a surface, such as a putting green, a floor, or any other surface in a training area. The golfer 13, holding a putter 25, assumes a normal putting stance, in relation to the target area or ball 29. If this stance is wrong, it is easy to correct as described below. The laser or other light source 10, if not on, is activated by pressing switch 40, and a spot of light 17, preferably a clear red dot formed without any fuzzy outside edges, because of the high reflective angle off of the reflecting surface 28. The spot of light is precisely controlled by the user by moving the external handle 32 to thereby move the levers 25 and 27 so as to rotate or move the body 30 and reflecting surface 28, to accurately place the spot of light 17 so as to illuminate a selected target area or spot on the ball 29. The connection and movement of the internal levers 25, 27 by external handle 32 allows very precise alignment of the red dot 17, and enables the golfer 13 to move the dot between the selected angles mentioned above. Furthermore, this accurate and precise movement of the reflecting surface 28 allows a clear and sharp image or light dot 17 to be consistently obtained in the desired position without having to adjust the position of a cap or visor on the golfer's head. Additionally, the lever operating mechanism of the device eliminates the need for angular or location repositioning on the bill of the cap or visor, thus making the device significantly easier to use for the golfer.

The golfer 13 then, if he or she has not already done so, finds the "sweet spot" on a head the putter 25, in a known manner, and aligns the sweet spot with the target area or golf ball 29. Once the golfer 13 has aligned the sweet spot on the club head, the golfer takes a normal stroke with the putter 25, and notes any light dot movement, with respect to the center of the target area or golf ball 29. The golfer repeats the putter stroke process as described above, and concentrates on holding the light dot 17 steady on the target area or ball 29. Once the golfer 13 has successfully achieved the required skill in such a putting stroke, without moving the dot of light 17 off the target area or ball 29 when putting, the golfer resumes a normal stance over the target area or golf ball 29, with the putter head aligned, and aims the laser dot 17 onto a further target spot or cup 38. The golfer 13 traces a preferred travel line 21 between the target area or ball 29 and the further target spot or cup 38 (see FIG. 6) with the laser dot 17, either from the target spot or cup 38 back to the target area or golf ball 29, or the other direction, along the preferred line of the ball travel.

As discussed above, the face of the putter head is lined up with the target area or ball 29, and is moved by the golfer toward the further target spot or cup 38, from the target area or ball 29. The golfer 13 practices putter strokes attempting to sink the ball into the cup 38, while preventing unnecessary movement of his or her body or head. By using the device 10 of the present invention as described above, players improve their putter stroke by making it more consistent. This device 10 allows the golfer to consistently hit the ball and make the ball move the same distance after being struck, thereby improving the golfer's putting stroke when not wearing the device of the present invention when putting during an actual game at a golf course or other putting green. Additionally, the device of the present invention improves the player's putting stroke, while improving one's ability to stroke the ball and spike the "sweet spot" of the putter. Using the device of the present invention, the player's sensitivity to very slight body or head movements is improved, thereby improving the effects of the putting stroke. Finally, the device of the present invention improves a player's targeting of a hole by visualization of the line of travel of the ball after a putting stroke along the preferred line 21 formed between the target area or golf ball 29, and the further target spot or cup 38. The golfer 13 continues repeating the putter stroke until he or she has successfully achieved the required skill in such a putting stroke, without moving the dot of light 17 off the target area or ball 29 when striking it.

Those skilled in the art will appreciate that there are adaptations and modifications of the just-described preferred embodiments that can be configured without departing from the scope and spirit of the invention. Therefore, it is to be understood, that within the scope of the intended claims, the invention may be practiced other than is specifically described herein.

What is claimed is:

1. A device for aiding a golfer in improving a putter stroke, comprising:

a housing having a holding clip for removably attaching the housing under a brim of a hat or a visor worn by the golfer;

a laser light source held in the housing;

a P.C. board held in the housing;

a power source connected to the laser light source and the P.C. board;

an on/off switch held in the housing and controlling the laser light source;

a further on/off switch on the P.C. board to turn off the power source if a predetermined elevation of the device is achieved; and a deflecting means held in the housing for deflecting a beam of light formed by the laser through an opening in the housing to a desired target.

2. The device of claim 1 wherein the deflecting means is a reflective surface rotatably held in the housing.

3. The device of claim 2, further including a handle mounted on an exterior surface of the housing and operatively connected to the reflective surface for rotating the same.

4. The device of claim 3, further including a body for supporting the reflective surface in the housing, the body being operatively secured to the handle.

5. The device of claim 4, further including a lever system mounted in the body and connected between the handle and the body for precise movement of the reflective surface in the housing.

6. The device of claim 5 wherein the device is sized and dimensioned so that the beam of light is projected from a spot close to the golfer's forehead and between the golfer's eyes to minimize parallax between the projected beam of light and a normal eye visualization path of the golfer.

7. The device of claim 1, further including a lever system mounted in the body and connected between the handle and the body for precise movement of the deflecting means in the housing.

8. The device of claim 7 wherein the deflecting means is a reflective surface rotatably held in the housing.

9. The device of claim 8, further including a handle mounted on an exterior surface of the housing and operatively connected to the reflective surface for rotating the same.

10. The device of claim 9, further including a body for supporting the reflective surface in the housing, the body being operatively secured to the handle through the lever system.

11. The device of claim 10 wherein the lever system includes a first lever connected to a shaft mounted in the body and to the handle and a second lever operatively connected to the first lever and the body.

12. The device of claim 11 wherein the first lever includes a fork shaped element and the second lever includes an enlarged portion captured in the fork shaped element.

13. The device of claim 12 wherein the device is sized and dimensioned so that the beam of light is projected from a spot close to the golfer's forehead and between the golfer's eyes to minimize parallax between the projected beam of light and a normal eye visualization path of the golfer.

14. A device for aiding a golfer in improving a putter stroke, comprising:

a housing having a holding clip for removably securing the housing under a brim of a hat or a visor worn by the golfer;

a laser light source held in the housing;

a P.C. board held in the housing and connected to the laser light source;

at least one battery connected to the laser light source and the P.C. board;

an on/off switch held in the housing and controlling the laser light source;

a reflective surface rotatably held in the housing and connected to a plurality of levers and an external handle for precisely controlling the deflection of a beam of light formed by the laser through an opening in the housing to a desired target.

15. The device of claim 14, further including a body for supporting the reflective surface in the housing, the body being operatively connected to a first of the plurality of levers.

16. The device of claim 15 wherein the plurality of levers includes a second lever connected to a shaft mounted in the body and to the handle and the first of the plurality of levers.

17. The device of claim 16 wherein the first of the plurality of levers includes a fork shaped element and the second lever includes an enlarged portion captured in the fork shaped element.

18. A device for aiding a golfer in improving a putter stroke, comprising:

a housing having a holding clip for removably securing the housing under a brim of a hat or a visor worn by the golfer;

a laser light source held in the housing;

a P.C. board held in the housing and connected to the laser light source;

at least one battery connected to the laser light source and the P.C. board;

an on/off switch held in the housing and controlling the laser light source;

a body supporting a reflective surface rotatably held in the housing and connected to a first lever and a second lever;

an external handle connected to the first lever for moving the second lever to precisely control the deflection of the reflective surface and a beam of light formed by the laser impinging thereon, through an opening in the housing to a desired target.

19. The device of claim 18 wherein the first lever includes a fork shaped element and the second lever includes an enlarged portion captured in the fork shaped element.

20. The device of claim 18 wherein the device is sized and dimensioned so that the beam of light is projected from a spot close to the golfer's forehead and between the golfer's eyes to minimize parallax between the projected beam of light and a normal eye visualization path of the golfer.

* * * * *